United States Patent [19]

Sulzberger

[11] Patent Number: 4,871,014

[45] Date of Patent: Oct. 3, 1989

[54] SHELL AND TUBE HEAT EXCHANGER

[75] Inventor: Kevin J. Sulzberger, Orange, Calif.

[73] Assignee: Tui Industries, Anaheim, Calif.

[21] Appl. No.: 197,658

[22] Filed: May 23, 1988

Related U.S. Application Data

[60] Division of Ser. No. 795,240, Nov. 5, 1985, abandoned, which is a continuation-in-part of Ser. No. 582,975, Feb. 23, 1984, abandoned, which is a continuation of Ser. No. 479,234, Mar. 28, 1983, abandoned.

[51] Int. Cl.[4] ..... F28F 9/06

[52] U.S. Cl. ..... 165/76; 165/82; 165/158; 165/160; 165/174; 165/178; 165/179; 165/184; 277/124; 285/137.1; 285/350; 285/910

[58] Field of Search ..... 165/70, 82, 158, 159, 165/160, 161, 176, 177, 178, 179, 174, 184, 76, 11.1; 277/124, 125, 168, 169, 170, 171, 177, DIG. 6; 285/137.1, 910, 350

[56] References Cited

U.S. PATENT DOCUMENTS

| | | | |
|---|---|---|---|
| 825,905 | 7/1906 | Hellyer . | |
| 844,525 | 2/1907 | Lee | 277/124 |
| 1,672,650 | 6/1928 | Lonsdale . | |
| 1,683,236 | 9/1928 | Braun . | |
| 1,738,455 | 12/1929 | Smith . | |
| 1,790,828 | 2/1931 | McKnight . | |
| 1,842,389 | 1/1932 | Dalzell . | |
| 2,000,653 | 5/1935 | Wilkinson . | |
| 2,187,555 | 1/1940 | Flindt . | |
| 2,658,728 | 11/1953 | Evans, Jr. . | |
| 2,825,463 | 3/1958 | Thomas | 285/137.1 |
| 3,566,615 | 3/1971 | Roeder . | |
| 3,768,554 | 10/1973 | Stahl . | |
| 3,792,729 | 2/1974 | Perry | 285/137.1 |
| 4,105,065 | 8/1978 | Chirico . | |
| 4,114,598 | 9/1978 | Van Leeuwen . | |
| 4,210,199 | 7/1980 | Doucett et al. . | |
| 4,234,197 | 11/1980 | Amancharla | 277/125 |
| 4,253,516 | 3/1981 | Giardina . | |
| 4,267,020 | 5/1981 | Burack . | |
| 4,475,584 | 10/1984 | Martin et al. . | |

FOREIGN PATENT DOCUMENTS

| | | | |
|---|---|---|---|
| 126097 | 11/1968 | Czechoslovakia . | |
| 52522 | 5/1982 | European Pat. Off. . | |
| 66425 | 12/1982 | European Pat. Off. . | |
| 882095 | 5/1953 | Fed. Rep. of Germany . | |
| 1501531 | 6/1972 | Fed. Rep. of Germany . | |
| 2111387 | 9/1972 | Fed. Rep. of Germany . | |
| 2442027 | 3/1976 | Fed. Rep. of Germany . | |
| 2742877 | 3/1979 | Fed. Rep. of Germany . | |
| 2320125 | 3/1980 | Fed. Rep. of Germany . | |
| 3214271 | 12/1982 | Fed. Rep. of Germany . | |
| 2186120 | 1/1974 | France . | |
| 2383418 | 10/1978 | France . | |
| 2347642 | 7/1979 | France . | |
| 269559 | 12/1933 | Italy . | |
| 24401 | of 1909 | United Kingdom | 285/137.1 |
| 260066 | 10/1926 | United Kingdom . | |
| 273605 | 7/1927 | United Kingdom . | |
| 339869 | 12/1930 | United Kingdom . | |
| 619585 | 3/1949 | United Kingdom . | |
| 730284 | 5/1955 | United Kingdom . | |
| 1187366 | 4/1970 | United Kingdom . | |

OTHER PUBLICATIONS

Afgan, N. H. and E. U. Schlunder, Ed., Heat Exchangers: Design Theory Sourcebook, Scripta Book Company and McGraw-Hill Book Company, pp. 177–182 and 192–199 (1974).

*Primary Examiner*—John Ford

*Attorney, Agent, or Firm*—Scherlacher, Mok & Roth

[57] ABSTRACT

A tube and shell type heat exchanger providing multi-pass contraflow of two heat exchange fluids includes a cylindrical outer shell, a modular baffle assembly guiding a shell fluid, a plurality of multi-wall tube sets and a pair of opposed end assemblies. A fixed end assembly fixedly receives one end of the tube sets and provides manifolding for directing multi-pass tube fluid flow through the tube sets. An opposite, floating end assembly slidably receives and seals floating tube ends to accommodate temperature induced expansion and contraction. The floating end assembly also provides manifolding for directing the multi-pass tube fluid flow through the tube sets. A triple wall tube set may be employed to provide extra protection against contamination of heat exchange fluids.

13 Claims, 8 Drawing Sheets

FIG. 5
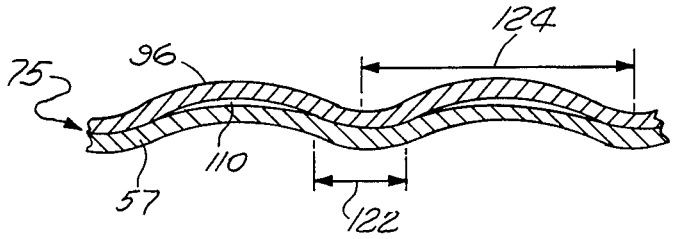
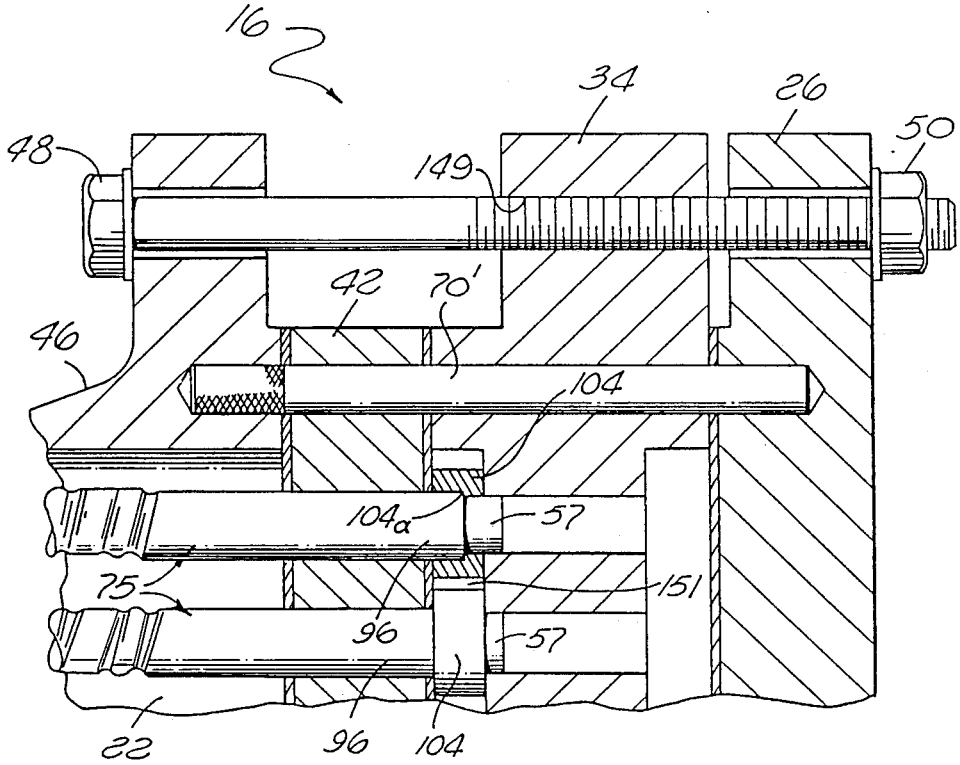
FIG. 8

FIG. 12
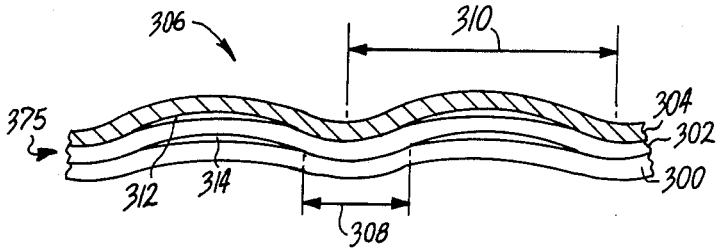
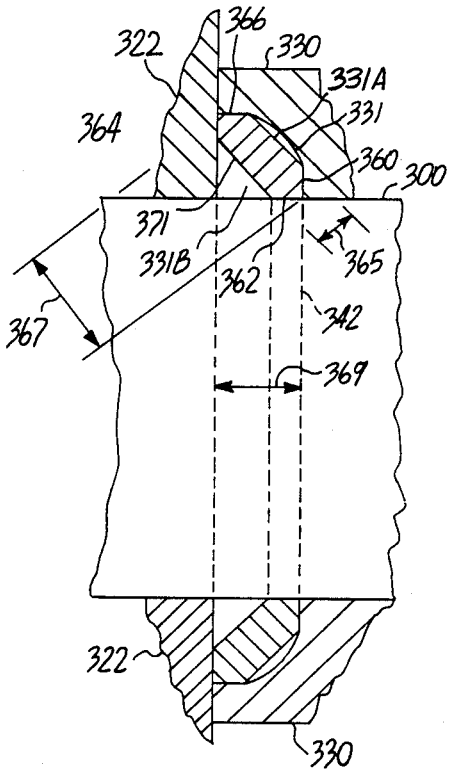
FIG. 14

SHELL AND TUBE HEAT EXCHANGER

CROSS-REFERENCE TO RELATED APPLICATION

This is a divisional application of copending patent application Ser. No. 795,240, filed Nov. 5, 1985, now abandoned, which is a continuation-in-part application of Ser. No. 582,975, filed Feb. 23, 1984, now abandoned, which is a continuation of application Ser. No. 479,234, filed Mar. 28, 1983, now abandoned by Kevin J. Sulzberger, for "SHELL AND TUBE HEAT EXCHANGER".

BACKGROUND OF THE INVENTION

The past decade has witnessed increased public and industry awareness of the need to utilize all available energy resources with maximum efficiency. One area of particular interest is the utilization of so-called "waste heat" that is associated with many, if not most, heavy industrial processes. The recovery and utilization of such heat provides potential benefits in terms of increased efficiency of production in the food processing, petroleum and refining and energy production industries, for example.

In all of the named industries, thermal energy constitutes a major process by-product. Limitations upon the attainable efficiency of energy utilization necessarily result in the loss of some thermal input via nonproductive radiation and the like. Numerous heat exchangers have been devised for transferring the heat stored in a first medium to a second medium for subsequent use or disposal. However, various drawbacks have limited the efficiency and versatility of heat exchangers in handling a wide range of fluids, especially those of high temperature and high pressure. Several features are essential for efficient heat transfer in shell and tube type heat exchangers. Frequently, multi-walled tubes are employed where two fluids must be protected against mixing even when a leak occurs.

A large tube surface area is necessary for effective heat transfer and the surface area increases with tube length and tube diameter. However, the advantage gained from a larger tube diameter is offset by a decreased heat exchange which results from a fluid inside of the large tubes tending to flow through the middle area of the tube where heat transfer is lowest rather than adjacent the peripheral tube wall where heat exchange is greatest. A long tube length poses a problem with longitudinal expansion. When a high temperature shell fluid is processed, the tube temperature increases and the multi-wall tubes expand individually. To avoid overstressing any of the multi-wall tubes, expansion means are needed for each individual tube. In addition, the design of the tube expansion means should be able to accommodate a leakage detection system.

Another factor affecting the rate of heat exchange is the flow of the fluids in relation to each other. Optimum heat transfer is achieved when the shell fluid and tube fluid are in contraflow relation on every pass. To achieve the multipass but contraflow relationship, leakproof baffles are needed to keep the shell fluid passing sequentially through one chamber at a time and to reverse the direction of flow at each end of the shell. Headers are needed to divert the tube fluid flow through the tubes into several sequential passes through the heat exchanger.

The use of a long multi-pass exchanger handling high temperature, high pressure fluids is not practical since the thermal stress at each end that is induced by temperature differentials causes the whole heat exchanger to bend or beam, resulting in intolerable mechanical distortion. High pressure, high temperature fluids that are reactive or corrosive to tube material present other problems in heat exchanger design. It is important not only to keep these fluids isolated from each other to prevent contamination but also to provide an efficient means for leak detection for the multi-wall tubes. To facilitate low cost maintenance it is essential to provide for quick access to the internal heat exchanger elements so that such elements can be readily interchanged with minimal time and effort.

U.S. Pat. No. 1,683,236 to Braun discloses an integral shell and tube heat exchanger with multi-pass tube flow but only double pass shell flow directed by a single central divider. This design decreases the heat transfer efficiency because it can not achieve complete counterflow on each pass of shell fluid in relation to tube fluid. The use of single wall tubes secured in fixed tube plates prevents efficient leak detection between the transfer fluids and does not allow for tube expansion. The integral shell provides no means to reduce the thermally induced stress that causes mechanical distortion in high temperature multi-pass shell and tube heat exchangers.

U.S Pat. No. 1,790.828 to McK four-pass shell and tube heat exchanger with contraflow on each pass of the shell fluid in relation to each pass of the tube fluid. This four pass contraflow is achieved through a longitudinal, vertical and horizontal baffle that extended through the shell, dividing the shell into a plurality of water tight chambers. This design is satisfactory for pre-heaters where temperatures are low but not for applications requiring higher temperature refrigerants. This design fails to provide for tube expansion that occurs at higher temperatures and does not take into account thermally induced mechanical distortion that occurs in high temperature shell and tube heat exchanges of the multi-pass type.

U.S. Pat. No. 1,672,650 to Lonsdale discloses a shell and tube heat exchanger with a floating head and multiple baffles welded to an inner central tube. The ends of the baffles are fitted into resiliently packed slotted tubes which are in turn welded to the shell. Although this design achieves multi-pass shell flow, it only allows for double-pass tube flow which results in inefficient heat transfer since complete counterflow is not obtainable. The baffle and tubes can be taken out of the shell for repair and replacement, but substantial effort is required to maintain the leak-proof joint in the slotted tube which is sealed with packing.

German Pat. No. 2,111,387 discloses a horizontal shell and tube heat exchanger. Single wall tubes are used with neither leak detection nor expansion means. The tubes are fixedly attached at each axial tube end to a tube plate in each end cover. A liquid or gaseous medium could be used as a shell fluid and radial and longitudinal baffles extend the entire length of the shell to provide for a multi-pas shell flow. Radially extending partitions in the deflecting end covers provide a multipass flow through the tubes. The longitudinal baffles are attached to a central tube which extends from one tube end plate to the other. This connecting tube increases the stability of the baffles. Although this heat exchanger could be operated in co-current flow or countercurrent flow, the heat exchanger's application is limited by temperature and pressure restraints.

Another problem present in the art of shell and tube heat exchanger is an accurate, efficient method for the leakage detection between transfer fluids.

U.S. Pat. No. 1,738,455 to Smith discloses a steam condenser that utilizes a double walled tube. A high pressure fluid flows within an outer tube wall which surrounds an inner tube wall containing a lower pressure contaminating fluid. If the inner tube leaks, the difference in pressure between the two fluids prevents fluid in the inner tube from leaking out and instead forces the higher pressure fluid to leak into the inner tube. This double wall system effectively isolates the contaminating fluid when the inner tube leaks but does not provide a leakage detection system for a heat exchanger.

In the Smith system each tube end of the double wall tube configuration terminates in a separate tube plate sealed by packing. In order for the Smith arrangement to achieve readily accessible and replaceable tubes without removing the outside tube plates, the tube plates are provided with openings that are sufficiently large for the outer tubes to pass through them. A disadvantage of this system is that the tube ends terminating inside each tube plate must be excessively packed to prevent leakage and the inner tube must have its tube end expanded to compensate for the tube plate modification for the outer tube.

British Pat. No. 273,605 to Thornycroft discloses a steam condenser wherein the steam is condensed by a passage of cooling water through single wall tubes that extends between two tube plates in each end of the condenser. The tube ends are not fixedly attached to the tube plates and are free to longitudinally expand. Each tube end is packed with packing rings which are compressed in place by ferrules. The ferrules screw into each tube plate to form a watertight joint. Surrounding the tube ends between the two tube plates is a fresh water chamber. As in Smith's Pat. No. 1,738,455, if the tube end leaks, seawater inside the tubes, being at a lower pressure than the fresh water outside the tubes, cannot leak out and contaminate the fresh water.

Other practical considerations in any design of a shell and tube heat exchanger include the accessibility and replaceability of the internal elements and means for compensating the internal elements in accordance with temperature changes.

British Pat. No. 730,284 to Pepper discloses a double wall system for a shell and tube heat exchanger that utilizes a vent chamber and bonded tubes. The tubes ends are fixedly attached to two tube plates at each end of the shell with a space therebetween. The outside surface of the inner tube wall has helical channels or grooves cut into it so that leaking fluid can flow along the tube length to a vent chamber for detection. The disadvantage of bonding is that it prevents any longitudinal expansion of the tubes and the tube ends must be fixedly attached to the tube plates to seal the vent chamber for efficient leak detection. Bonding also increases tube cost and fixedly attached tube ends prevent use of accessible and replaceable tubes.

U.S. Pat. No. 2,658,728 to Evans discloses a method for longitudinal expansion of double wall tubes by having expansion joints on the shell. Evans uses two bellows type expansion joints. A first joint compensates for expansion of the outer tube and a second joint compensates for the expansion of the inner tube. These expansion joints increase the cost of shell construction and require both tube ends to be welded in respective tube plates. This construction eliminates efficient accessibility and replaceability of double wall tubes. Nor does this arrangement accommodate differential expansion of different chambers within the heat exchangers.

British Pat. No. 619,585 to Newling discloses a vertical shell and tube heat exchanger with a lining between the shell and tube bundle to reduce the amount of transfer fluid that flows through the tube area. The shell must be constructed with a large bore that enables the tube bundle and the floating head to be removed as a single unit in the event of repair or replacement. The shell fluid inlet and outlet ports are not sealed between the shell and the lining so that a thick axially extending space contains a thick layer of stagnant shell fluid. Although this thick layer of stagnant fluid acts as a thermal insulator it does not reduce the thermally induced stress that causes mechanical distortion in high temperature multi-pass shell and tube heat exchangers.

U.S. Pat. No. 3,768,554 to Stahl discloses a vertical liquid-metal vapor generator with a wrapper sheet separating a tube bundle from the generator's shell. An annular space between the wrapper sheet and the shell shields the shell from rapid temperature transients. A layer of liquid metal six inches thick fills this annular space and remains stagnant throughout the generator's operation. This type of shielding utilizes the thermal conduction resistance and heat capacity of the liquid metal itself to decrease the heat transmission.

U.S. Pat. No. 4,114,598 to Van Leeuwen discloses a solar heater with two sided extrusions interlocked in a tongue and groove fashion. This method of interlocking is practical for solar heater elements lying in a horizontal plane but would be of no use in forming the circumferential shell of a heat exchanger. A circumferential pressure vessel shell needs three line locks to sealingly interlock the shell and a radial and circumferential segment on the extrusion to form the shell and its inner chambers.

U.S. Pat. No. 825,905 to Hellyer discloses a drying machine where a series of triangle cells mounted and interposed between the walls of a jacket surround a cylindrical main body portion. Although the cells are removable and form a symmetric outer shell, they have no interlocking elements or radial and circumferential segments that form a segmented and baffled self sealing shell for use in a heat exchanger of the shell and tube type.

In summary, while a shell and tube type heat exchanger presents a relatively simple design, there are a number of problems that have reduced its overall efficiency in its present state. There exists a need in the art for a shell and tube heat exchanger of low cost modular construction that is easy to maintain and repair and that can meet pressure vessel regulations while yielding high efficiency heat transfer over a wide range of fluids. A high quality, multi-pass heat exchanger should provide an efficient leak detection system that allows for individual longitudinal expansion of multi-walled tubes and a means to substantially reduce thermally induced stress that causes mechanical distortion while keeping the cost low.

SUMMARY OF THE INVENTION

A high efficiency multiple wall tube and shell heat exchanger for high pressure, high temperature fluids includes an outer pressure shell, a modular inner shell, and expansion and stress compensation to prevent mechanical distortion. The modular inner shell is made out of heat conductive extrusions. Each extrusion has an integral circumferential segment and a radial baffle segment and sealingly interlocks with adjacent segments at the radially inner and outer edges to form a watertight segmented inner shell. The baffle segments form internal integral axially extending baffles which are configured to provide five pass flow for shell fluid. A sealed inlet and an unsealed outlet provide fluid passages for shell fluid from the interior of the inner shell to the exterior of the outer shell. The outlet provides communication of shell fluid to a gap which exists between the modular inner shell and the outer pressure shell. A pair of opposed end assemblies each include radial flow dividers. The end assemblies are coupled at opposed axial ends of the shell to pass a tube fluid through the tubes in five pass counterflow relation to the shell fluid. The end assemblies receive and seal the ends of the tubes in a stress relieving relationship.

The baffle segments form a plurality of chambers in the modular inner shell. Each chamber receives a plurality of multi-walled helically grooved heat conductive tubes forming tube sets or tube members which extend throughout the length of the shell and into the opposed end assemblies. The end assemblies are coupled at the axial ends of the shell by bolts and nuts. Each multi-walled helical tube set has a thin space between the inner tube wall and the outer tube wall which channels any leaking fluid from either tube to a vent chamber in the floating end assembly which goes to the atmosphere for leakage detection.

The multi-walled tube sets are formed in a helical groove design with precise groove dimensions to achieve maximum heat exchange efficiency between the shell fluid and tube fluid. The grooves produce a turbulent flow inside the multi-walled tube which increases heat transfer efficiency by causing all portions of fluid the tube flow stream to come in contact with the wall of the inner tube. The width of the groove metal to metal contact area is limited by a need for a minimum percentage of venting area within the tube, whereas the depth of the groove is such that the amount of energy needed to pump the fluid through the tube is minimal. The walls of the individual tubes remain of uniform thickness to pressure optimum strength throughout the lengths of the tubes. A hollow bushing is positioned around each multi-wall tube transition in each end assembly where the outer tubes; separated from the inner tubes. The hollow bushing has two different inner diameters that correspond to the respective larger and smaller tube diameters of the multi-walled tube set. Bushings in the floating end have a central radial aperture and tapered seals that sealingly fit inside the bushing at each axial end. This seal is maintained by the compression forces exerted by the tie rods and nuts which couple the end assembly to the shell.

Each of the two opposed end assemblies consists of a number of internal elements that are assembled in laminated fashion and secured by bolts and nuts so that access to the interchangeable elements within the shell requires minimal time and effort. One of the end assemblies is called the floating end and contains a vent chamber defined between an inner tube sheet and an outer tube plate or alternatively between a tube plate and a center plate. The vent chamber is positioned at a transition in the slidably coupled multi-walled tubes. The floating end assembly allows each multi-walled slidably coupled tube to longitudinally expand and contract individually and apart from any other multi-wall tube. A tapered seal or a bushing in the floating end couples leakage fluid to the vent chamber. The other end assembly is fixed and receives the fixed ends of the multi-walled tubes in a non sliding manner. The fixed end assembly also differs from the floating end assembly in that there are no tapered seals for sealing purposes but has a vent chamber for leakage detection in case of gasket failure. In addition the hollow bushing has no central radial aperture in it. Instead, a gasket is placed on each side of the bushing adjacent to the tube sheet and tube plate to form a seal. If a leak in the gasket occurs the leaking fluid will leak into the atmospheric vent chamber located at the floating end, thus preventing any possibility of contamination between the shell fluid and tube fluid.

The mechanical distortion that is induced by temperature differentials common in high temperature, high pressure fluids in multi-pass shell and tube heat exchangers is minimized by an inner shell and outer shell construction in which a thin layer of exiting shell fluid from the unsealed outlet slowly circulates in a space between the inner and outer shells. This circulation reduces any temperature differential between the inner and outer shells to prevent beaming or bending of the heat exchanger. This circulation also keeps any difference in temperature between the outer pressure shell and inner shell for any given segment within temperature differentials allowable to meet pressure vessel regulations.

The overall construction and geometry of the multi-wall, multi-pass, high temperature, high pressure heat exchanger assures high thermal efficiency with relatively low production and assembly costs while facilitating convenient replacement of component parts. The exchanger is particularly suitable for applications where leakage is intolerable, such as potable water systems in which thermal energy is to be interchanged with a superheated refrigerant.

BRIEF DESCRIPTION OF THE DRAWINGS

A better understanding of the invention may be had from a consideration of the following Detailed Description, taken in conjunction with the accompanying drawings in which:

FIG. 5 is an enlarged cross sectional view of a portion of enhanced surface tubing taken about the indicated section line 5 of FIG. 4;

FIG. 8 is partial longitudinal cross section of the fluid #1 outlet end assembly, illustrating in part the heat exchanger tube expander bush and means of venting in case of gasket failure;

FIG. 12 is an enlarged cross sectional view of a portion of a triple wall tube set;

FIG. 14 is a cross sectional illustration of a seal used in the floating end assembly.

DETAILED DESCRIPTION

Figure 1:
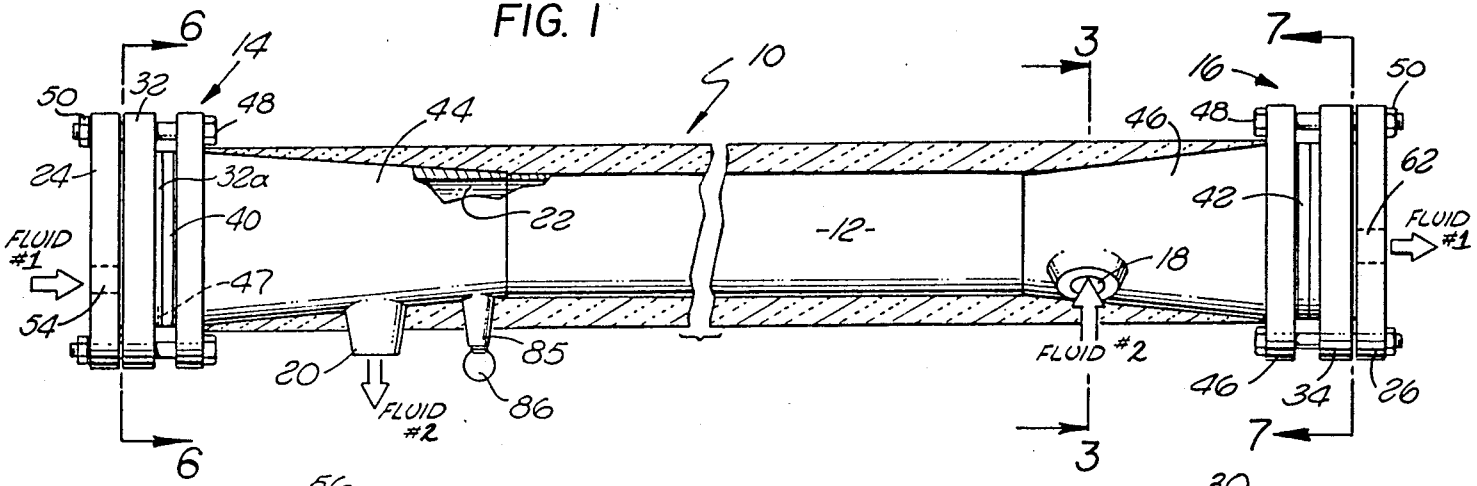
FIG. 1 is a wide side elevation view, partially broken away of a heat exchanger in accordance with the invention.

FIG. 1 is a side elevation view of a heat exchanger 10 in accordance with the invention. The heat exchanger 10 generally comprises an elongated cylindrical pressure vessel outer shell 12 that terminates in a floating end assembly 14 and a fixed end assembly 16 the floating end assembly 14 an inlet port 54 for first heat exchange fluid and the fixed end assembly 16 has outlet port 62 for the first heat exchange fluid. The invention contemplate that a first thermal exchange fluid, such as relatively cold potable water, is to enter the heat exchanger 10 through the inlet port 54 make a multi-pass flow through shell 12 and exit through the outlet port 62.

A second thermal exchange fluid, such as a superheated refrigerant (i.e., ammonia or halocarbon), is applied through an inlet port 18 providing an aperture through a neck flange 46 which forms an end portion of shell 12 at a fixed end thereof adjacent fixed end assembly 16. The second fluid makes a multi-pass flow through shell 12 contra to the first fluid and then exits the heat exchanger shell 12 through an outlet port 20 in a neck flange 44. The neck flange 44 forms a portion of shell 12 at a floating end thereof adjacent the floating end assembly 14.

The outer pressure vessel shell 12 is shown partially broken in FIG. 1, exposing a substantially cylindrical inner modular shell 22 having baffled chambers which may also be referred to as subchambers.

Figures 2A, 2B:
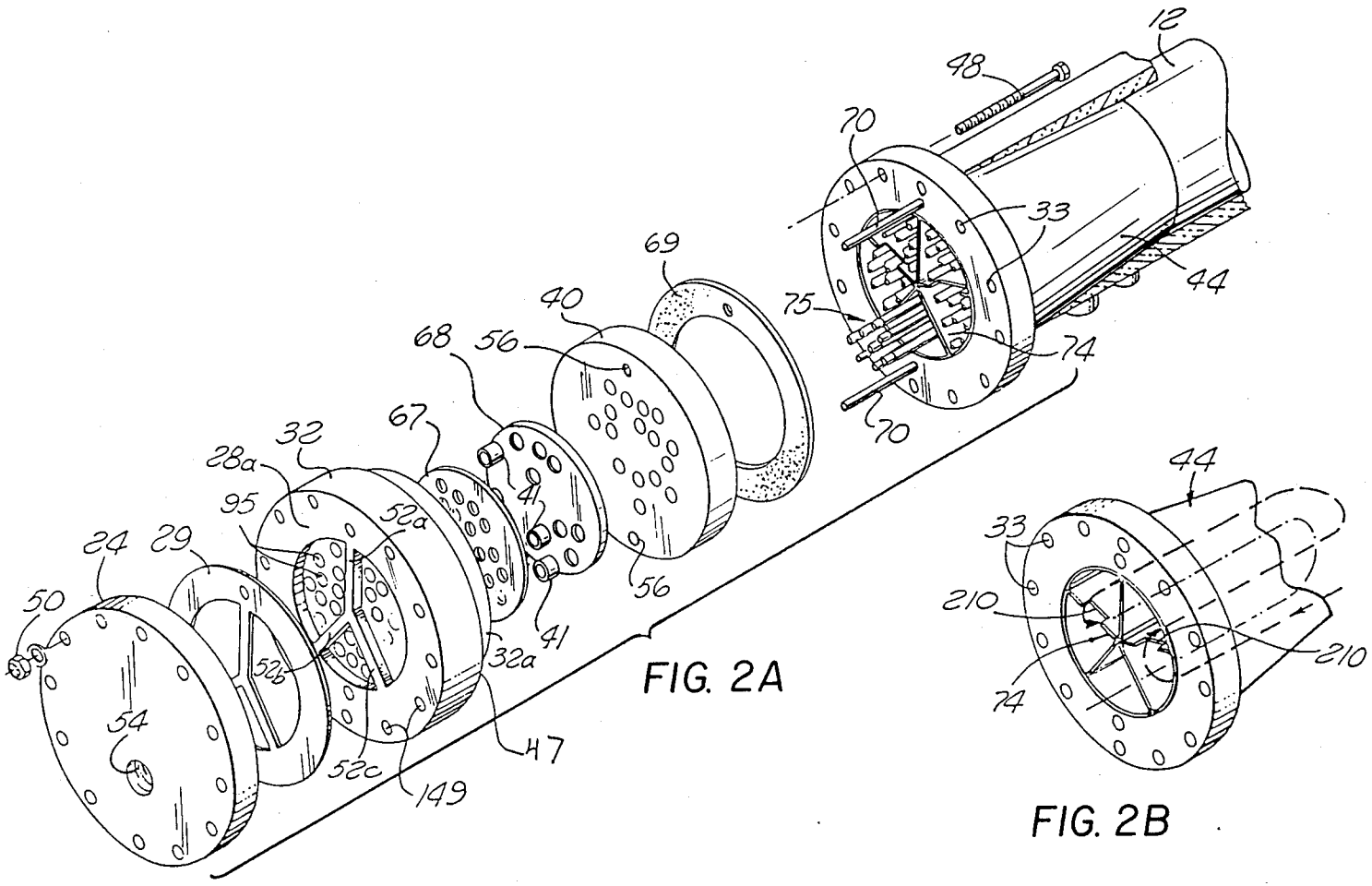
FIG. 2A is an exploded perspective view of the tube fluid inlet end assembly, the opposed or outlet end assembly being substantially the same.
FIG. 2B is a fragmentary view in perspective of the shell fluid flow within the heat exchanger with the end assembly and fluid-conducting tubes omitted.

The floating end assembly 14 is illustrated in greater detail in FIGS. 2A and 2B, to which reference is now made. A plurality of multi-walled heat exchange tube sets or members 75 are positioned within the modular shell 22 which is partitioned by a longitudinally extending baffle assembly 74. The baffle assembly 74 operates to effect a multi-pass, counterflow flow path for the second heat exchange fluid. The counter flow flow path optimizes a thermal exchange, between the first fluid within the multi-walled tubes 75 and second fluid within the modular shell 22. The assemblies for such purpose are illustrated in greater detail in subsequent drawing figures.

As shown in FIG. 1, neck flanges 44 and 46 are affixed to axially opposed ends of the pressure vessel shell 12 by welding or an equivalent process. For reasons which will become apparent, the neck flanges 44, 46 are conveniently identical in structure, but are rotatably offset 72° from each other prior to affixation to the shell.

The end assemblies 14, 16 respectively comprise a laminated arrangement of elements joined to neck flanges 44 and 46 respectively by a plurality of bolts 48 peripherally arranged about the end assemblies 14 and 16 and threadedly engaged to center pressure flange 32 and 34 then engaged to nuts 50. As shown in FIGS. 1 and 2A, the floating end assembly 14 includes an end cap 24, a center pressure flange or center plate 32, an inner tube sheet or plate 40 and a flange gasket 69 which seals end assembly 14 to the shell 10. A tube plate gasket 67 and 68 seal the center plate 32 to the tube plate 40 and a cap gasket 29 seals cap 24 to the center plate 32. The fixed end assembly 16 similarly includes an end cap 26, a center pressure flange or center plate 34, and an inner tube sheet or tube plate 42. Fixed end assembly 16 is sealed by a set of gaskets which correspond to those described for the floating end assembly 14 and are therefor not described in detail.

The neck flange 44 conveniently includes exit port 20, through which the second heat transfer fluid exits, as well as a port 85 for a pressure relief valve 86. Both ports communicate with the modular shell 22 as subsequently described in greater detail. By including both ports 20 and 85 as part of the neck flange, the ports may be formed as part of a casting process by which the flange is conveniently made. This provides a less expensive alternative to drilling apertures in the shell 12 and welding to the shell 12 internally threaded fittings.

The axially extending, chamber partitioning baffle assembly 74, which also forms the circumferial wall of the modular shell 22, partitions the modular shell into five fluid tight axially extending chambers. Each of the five chambers encloses a defined group or nest of multi-walled heat exchange tube sets 75.

Figure 3:
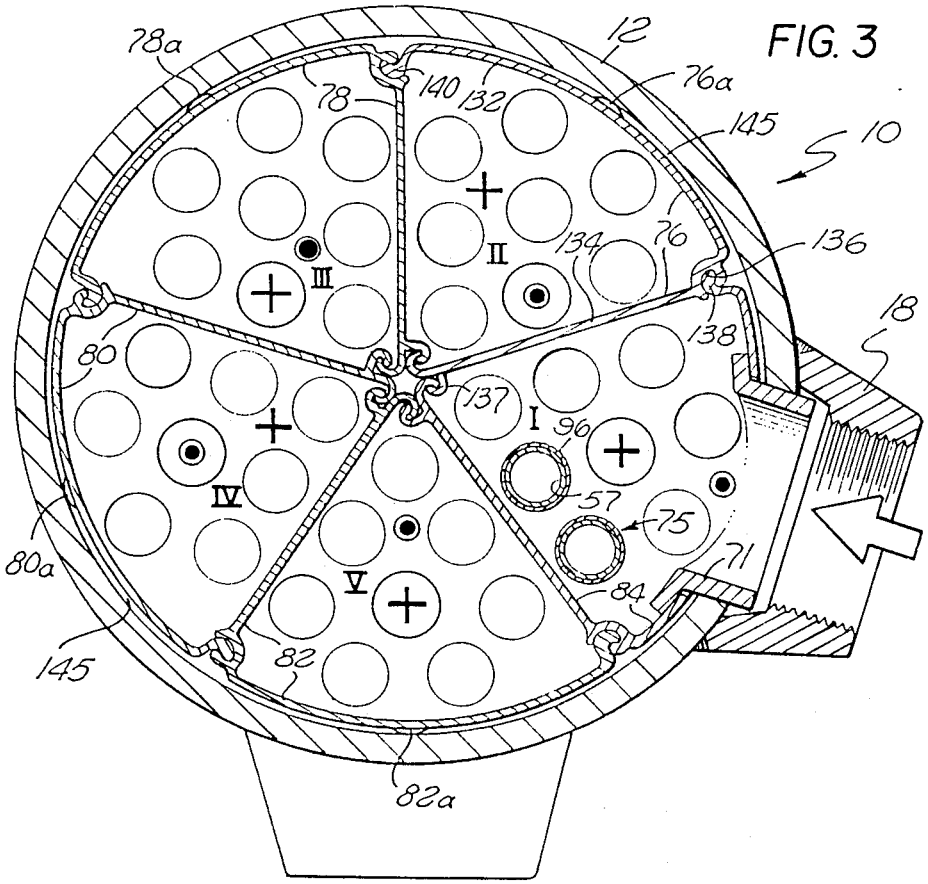
FIG. 3 is a cross-section of the heat exchanger taken at 3—3 of FIG. 1.

FIG. 3 is a cross-section of the heat exchanger 10 taken along line 3—3 in FIG. 1. As shown in FIG. 3, the baffle assembly 74 is seen to be formed from five slidably but sealingly double interlocking baffle member extrusions 76, 78, 80, 82 and 84 which may be simply and economically formed from, for example, aluminum via an extrusion process. Referring in detail to the extrusion 76 by way of example, extrusion 76 is seen to comprise an integral radially extending arm 134 and a circumferentially extending arm 132 that forms a segment of inner shell 22 and conforms generally to the inner circumference of the pressure vessel shell 12.

Each integral circumferential arm 132 and radial arm 134 of each extrusion extends axially through the pressure vessel shell 12. The five circumferential arms form the outer periphery of the modular shell and the five radial arms form the inner fluid tight baffled chambers.

As shown in FIG. 3, the circumferential arm 132 of extrusion 76 extends generally circumferentially away from the radial arm 134 and sealingly joins the radially extending arm of adjacent extrusion 78 at a radially outer edge 140. The radial arm 134 of extrusion 76 sealingly joins the circumferentially extending arm of adjacent extrusion 84 at a radially outer edge 138. Similarly, the outer edge of the radially extending arm of each extrusion 76, 78, 80, 82 and 84 engages an extreme edge of a cantileveled circumferentially extending arm of an adjacent extrusion to form the inner shell 22. At each engagement a generally circular axially extending head engages a generally circular, axially extending aperture to provide an axially slidable seal between the two mating members.

In baffle assembly 74, extrusion 76 lies interjacent extrusions 84 and 78, with extrusion 84 being adjacent in a clockwise direction and extrusion 78 being adjacent counter clockwise. In extrusion 76 the radially inner portion of the radial arm 134 terminates in a hook shape adapted to interlock with a mating recepticle appendage of the radial arm of the counter-clockwise adjacent extrusion 78. Similarly, a receptacle appendage 137 is adapted to sealingly, but slidably interlock with the terminus of the clockwise adjacent radial arm of the extrusion 84. As shown in FIG.3, each radial arm butts against its adjacent neighbors and sealingly interlocks at both radially inward and radially outward edges thereof.

Construction of the baffle assembly 74 is particularly inexpensive. To assemble baffle assembly 74, a first extrusion 84 is placed inside the shell 12. The distal end of a second extrusion such as extrusion 76 is matingly aligned with the proximal end of the first extrusion and axially slid into mating engagement with the first extrusion 84. The shape of the interlocking beads and apertures precludes separation except by relative sliding of adjacent extrusions in the axial direction. Each of the third through fifth members is thereafter slid axially into place to complete the baffle assembly 74. The radially extending arms of the baffle members are slightly oversized to provide a radially directed compression of the assembly, effecting a seal where the radial arms abutt.

The circumferential arms of the extrusions include radially outward extending legs 76*a*, 78*a*, 80*a*, 82*a* and 84*a* which maintain a clearance of approximately 0.040 to 0.095 inches between the radially outer surface of the modular shell and the inner wall of the pressure vessel shell 12 to define a gap or chamber 145 therebetween.

FIG. 3 additionally illustrates a cross-section of the inlet 18 for the second heat exchange fluid and multi-walled tube sets 75 for conducting the first heat exchange fluid. The second heat exchange fluid enters the baffle chamber designated Sector I defined by extrusion 84 and radial arm 134, and flows axially out of the drawing. The inlet 18 includes an aluminum sleeve 71 which is sealingly passed through the aperture in the pressure vessel shell 12 into inlet 18 and expanded into position. Accordingly, the incoming second fluid cannot pass into the space between the modular shell and the inside wall of the pressure vessel shell 12. For reasons which will be explained subsequently, no corresponding expanded sleeve is associated with the outlet 20 or pressure relief port 85 (FIG. 1), thereby enabling a portion of egressing second fluid to fill the gap space 145 in operation.

It will be appreciated from a comparison of FIGS. 2A, 2B and 3, that the inlet 54 for the first heat exchange fluid is oriented to couple incoming fluid into a nest or group of tube sets 75 occupying the chamber designated Sector V defined by the baffle assembly. The baffle assembly 74 directs the second fluid sequentially in alternate axial directions through the chambers designated I, II, III, IV and V. The tube sets 75 and associated manifolding chambers formed by the end assemblies 14, 16 direct the first fluid in sequential and alternating counter flow axial directions through the chambers designated Sector V, IV, III, II and I.

Figure 4:
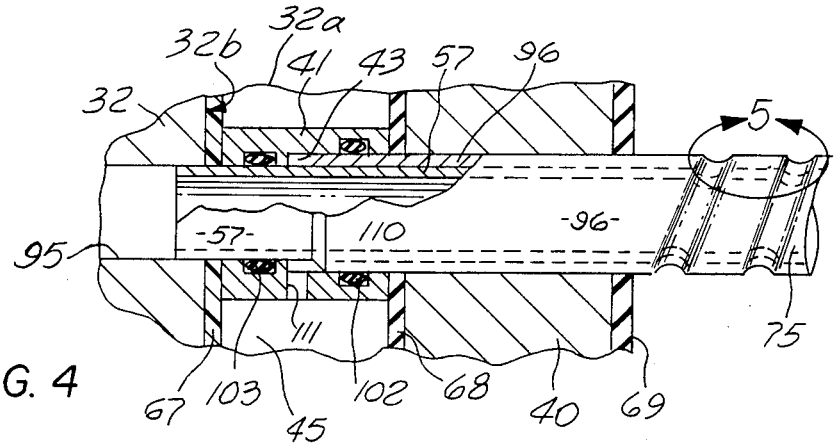
FIG. 4 is an enlarged longitudinal cross section of the fluid #1 inlet end assembly illustrating in part the heat exchange tube sealing and venting mechanisms.

As shown in FIGS. 4, 5 and 8, each multi-walled tube set 75 generally comprises at least an outer tube or wall 96 and an inner tube or wall 57 pressed together along a helical area of contact so that a gap or cavity 110 effectively spirals the length of the tube between adjacent spiral contact areas. If, for example, the outer tube 96 of a tube set 75 in chamber Sector I (FIG. 3) fractures, the second fluid in subchambers Sector I will enter the spiral cavity 110 and, in accordance with the invention, as subsequently described, such fracture will be detected by the venting of such fluid from within the cavity 110 to atmosphere. Similarly, if the inner tube 57 is breached, the first fluid will leak into the spiral cavity 110 and will thereafter be vented to atmosphere in accordance with the invention.

The configuration of multi-walled tube 75 (FIG. 5) has been designed to improve the heat transfer coefficient over conventional enhanced surface tubes. This improvement is achieved by providing a relatively wide spiral groove where the outer tube 96 and the inner tube 57 are pressed together, yielding greater area of metal contact 122. Additionally, by increasing the distance 124 between adjacent revolutions of the spiral groove to allow a thicker wetted surface to form, an increased heat transfer coefficient is provided. While it is known that enhanced surface tubing significantly increases the heat transfer of a particular tube diameter in heat exchange equipment, this invention provides a particular configuration wherein the controlling parameters are optimized. In particular, it has been found that a groove width 122 of approximately ⅛ inch and depth of approximately 3/32 inch assures good turbulation of the fluids on both sides of the tube set 75 while maximizing heat transfer without collapsing the tube set 75 during manufacture. The pitch 124 of the optimal tube is found to be 9/16 inch. A gap 110 of 0.003 inches was employed to meet venting regulations but should be kept at a minimum to ensure maximum heat transfer. By forming the spiral groove through deformation of the tubes in each tube set 75 and not by removal of material a uniform tube 57 and 96, wall thickness is maintained to optimize tube strength. In addition, while a two tube set 75 has been disclosed by way of example, each tube set could include three or more tubes for added safety, or protection from fluids hostile to the tube material.

Attention is now directed to the assembly procedure for heat exchanger 10, whereby the interrelationship of the various components will be more easily appreciated. With initial reference to FIG. 2A, the inner tube plate 40 is first mounted onto the neck flange 44 by means of positioning dowels 70 protruding from the neck flange 44. The dowels 70 receive the neck flange gasket 69 and tube plate 40. The dowels and dowel-receiving holes are similar to dowel 70 and holes 56 associated with tube plates 40 of the inlet assembly 14 and illustrated in FIG. 2A.

The tube plate 42, which is similar to plate 40 (FIG. 2A) includes a pattern of holes sized to accommodate the outer tubes 96 of the tube sets 75. The hole pattern corresponds to the pattern of the multi-walled tube sets 75 shown in FIG. 3.

Reference is now made to FIG. 8, a fragmentary sectional view of the fixed end of the heat exchanger 10. Each of the tube sets 75, to be inserted into modular shell 22 through a respective one of the holes in the inner tube plate 42, receives a bushing 104 over the fixed end thereof. The bushing 104 includes a through-hole having a stepped wall 104*a* such that the larger internal diameter portion of the bushing engages the outer tube 96 of the multi-walled tube set 75, while the smaller diameter portion of the bushing engages the inner tube 57 of multi-walled tube set 75. A general swaging tool may then be inserted into the tube, as is known in the art, to expand the tubes within the bushing and thereby effect respective seals between the bushing and the inner and the outer tubes, with the gap 110 between the inner and outer tubes being sealed against the step 104*a* of the internal bushing wall.

As the tube/bushing sub-assemblies are inserted into respective holes of the inner tube sheet 42, the leading face of each bushing contacts a gasket similar to gasket 68 against the outer face of the plate 42 and the trailing face of each bushing contacts a gasket similar to gasket 67 against the central pressure flange.

Before describing the completion of the fixed end assembly 16, attention is redirected to floating end assembly 14. Returning to FIGS. 1 and 2A, the neck flange 44 is shown to include a number of peripheral apertures 33 and an axially or longitudinally extending, peripheral dowel 70. The dowel 70 is adapted to pass through positioning holes respectively formed in the components of end assembly 14 when the components are mounted onto the flange 44.

Accordingly, an assembly comprising a gasket 69, a tube plate 40 interjacent two gaskets 68, 69 is mounted onto the neck flange 44. The tube plate 40 and gasket 68 include aligned hole patterns corresponding to the layout of tube holes 95 so that the tube sets 75 extend outward therethrough. As will be subsequently appreciated, the gasket assembly and the corresponding gasket assembly of outlet assembly 16 define the ends of the flow path for the second heat transfer fluid.

After the gasket 68 has been mounted against the tube plate 40, a generally annular bushing 41 is placed about each multi-walled tube 75 and slid back against the gasket assembly. The bushing 41 straddles the termination transition of outer tube 96. As shown in FIG. 4, each bushing 41 includes a pair of spaced apart O-rings 102, 103 for forming a tube expansion region 43 communicating with gap 110 in multi-walled tube 75. Into tube expansion region 43 is a radial hole 111 through bushing 41 which connects to gap 110 to a vent 45 chamber formed between tube plate 40 and center plate 32 to allow the tube to vent to atmosphere.

Next, gasket 67 is fitted over the protruding inner tubes 57 of tube sets 75. A center plate 32 is then correctly oriented via dowel 70 and assembled onto the neck flange 44. The axially inner face of center plate 32 butts against the gasket 67 which is against the outer face of the bushings 41, resulting in an outer annular portion 32*a* which circumvents the protruding bushings 41 and which is adapted to sealingly contact the gaskets 67 and 68 to define the vent chamber 4. The vent passage is completed with a vent hole 47 (FIG. 1) in center plate 32 annular portion 32*a*.

The aforedescribed arrangement is directed towards preventing the contamination of one of the heat exchange fluids by the other. Should the outer tube 96 of a tube set 75 fracture and permit the second fluid to enter and travel along helical gap 110, the fluid will enter region 43 pass through hole 111 then to atmosphere through hole 47. The second fluid will not escape from gap 110 at the outlet assembly 16 since the expansion of tube set 75 into bushing 104 at that end has sealed that bushing across the gap.

As shown in FIG. 4, bushing 41 includes a through-hole 111 through which any fluid in gap 110 will escape. The escaping fluid falls downward through chamber 45 and out of the end assembly via through-hole 47 in the bottom periphery of the pressure flange 32 and is detected by means hereinafter set forth so that the multi-walled tube 75 can be replaced before a subsequent fracture in inner tube 57 or other event permits a mixing of the first and second fluids. Similarly, a fracture of the inner tube 57 results in first fluid being restricted to region 43 and escaping via hole 111 and 47.

The center plate 32 additionally comprises a central portion 32*b* relatively recessed from the gasket-contacting surface of the annular portion 32*a*. The recessed portion contains a pattern of through-passages 95 located in alignment with the ends axially extending inner tubes 57 that protrude from bushings 41. The axially inward face of the recessed portion 32*b* surrounds each passage 95 thereby sealingly contacts the axially outward face of the respective bushing against gasket 67. The ends inner tubes 57 extend into, but do not protrude from the axially outward side of, passages 95.

The axially outer face of the center plate 32 includes an end baffle arrangement 28 comprising an annular portion 28*a* circumscribing the through-holes 95 together with a generally Y-shaped portion comprising generally radially extending bars 52*a, b,* and *c*. The bars 52*a, b,* and *c*, and annular portion 28*a* are adapted to sealingly contact the interior face of end cap 24 via gasket 29 and to thereby form a series of pressure chambers, as better explained by reference to FIGS. 6 and 7.

Figure 7:
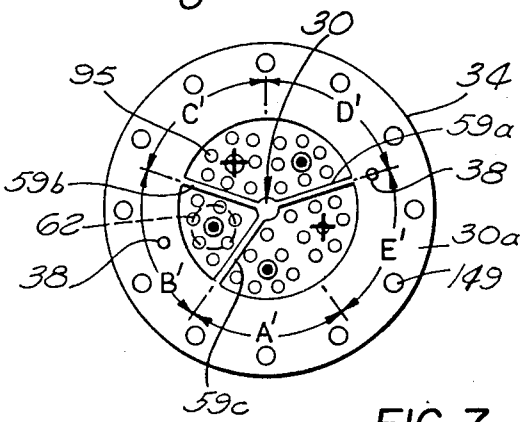
FIG. 7 is a cross sectional view of the fluid #1 outlet end assembly of the invention taken at 7—7 of FIG. 1.
Figure 6:
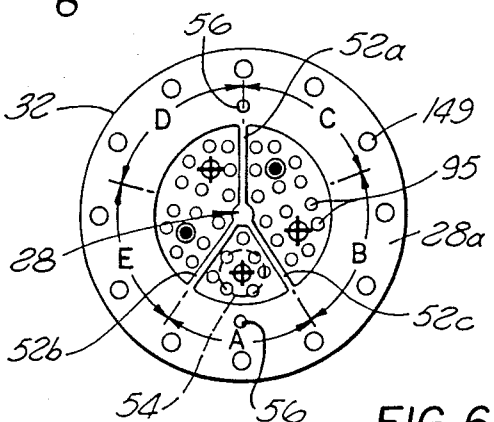
FIG. 6 is a cross sectional view of the fluid #1 inlet end assembly of the invention taken at 6—6 of FIG. 1.

FIGS. 6 and 7 are cross-sectional views of portions of the inlet and outlet end assemblies taken along the lines 6—6 and 7—7, respectively, of FIG. 1. As can be seen, the end assemblies are substantially similar. The plurality of bolt receiving holes 149 is provided about the outer periphery of pressure flange 32, 34.

End baffle 28, 30 illustrated in FIGS. 6 and 7 as comprising an annular steel portion 28*a*, 30*a*, with radial vane arrangements 52*a, b, c,* and 59*a, b, c*. The relative orientations of the vanes 28, 30 by a 72° rotational offset. Apertures 56, 38 in the annular portion of the baffles are provided for insertion about positioning dowels 70, 70' to provide the correct relative orientations of the vane arrangements within the end assemblies 14 and 16. Accordingly, the welding of neck flange 46 onto shell 12 at a rotational offset of 72° from the orientation of neck flange 44 permits identical components to be used in end assemblies 14, 16 except for bushings 41, 104.

The end baffles 28, 30 vanes define pressure chambers in the end assemblies 14, 16 that provide a fluid flow continuum or manifold for reversing the direction of the first heat exchange fluid within the thermal exchange tubes. The dashed circles 54 and 62 indicate the locations of the inlet port 54 and the outlet port 62 with respect to the vane arrangements 28 and 30 respectively. As can be seen, the radial fins of each arrangement subtend two obtuse and acute angle. In an actual reduction to practice of the invention, an acute angle of 72° and obtuse angles of 144° were employed.

The through passages 95 which the ends of the inner tube 57 engage into are shown in FIGS. 6 and 7. The axially outer faces 28*a*, 30*a* are illustratively divided into in 72° segments denoted "A" through "E" and "A'" through "E'", respectively. The three radial vanes of each end baffle cooperate with the interior of the respective end cap 24, 26 to define 3 end chambers at each end of the heat exchanger.

The flow of the first heat exchange fluid through the heat exchange occurs in the following sequence: the fluid enters the heat exchanger 10 under pressure at inlet port 54 (FIG. 6), distributing itself over the 72° section A to thereby enter inner tube 57 group of heat transfer multi-walled tubes 75 that are telescopically engaged within the passages 95 of the pressure plate 32. The fluid then travels in the tubes through the heat conductive modular shell 22 to the 144° section of the pressure chamber in the outlet end assembly 16 comprising the A′ and E′ segments (FIG. 7). As the fluid emerges from the tubes in section A′ under pressure, its only outlet from this section of the end chamber is the path commencing with the set of channels of section E′, through which it enters inner tubes 57 that transport the fluid back through the modular shell 22 to the inlet end 14 section. Emerging from the pipes of segment B (FIG. 6), the fluid can only enter the channels within segment C for transmission once again through the heat exchange chamber 22, and so forth. The end of one inner tube 57 within each of the defined segments of the end pressure chambers has been identified according to the direction of first fluid flow in the tube group of that segment, a "dot" indicating fluid flow emerging from the plane of the paper and a "cross" indicating flow into the plane of the paper. One can see that, by means of the particular design and relative orientations of the end baffles 28 and 30, a multipass fluid flow path is established for the first fluid through the modular shell 22.

Having described the multi-pass flow path of the first fluid, the path of the second fluid is next described. Turning to FIG. 3, the second fluid has been mentioned as entering section I of modular shell 22 via inlet 18. Radial arm 135 and 134 are sealed against tube sheet 40, (better appreciated by reference to FIG. 2) and therefore cannot pass out of section I via the #1 fluid outlet end 16 of the exchanger. The second fluid accordingly flows towards the #1 fluid inlet end 14 until it reaches the interface of segment I and inner tube sheet 40. While the entire radially directed length of radial arm 135 is sealed against tube sheet 40, a portion of the axially remote end of radial arm 134 terminates short of the tube sheet permitting the second fluid to flow around the remote end of arm 134 and back toward the outlet end 14 (FIG. 1) via segment II (FIG. 3) of the modular shell 22.

Similarly, the radial arm of extrusion 78 terminates short of tube sheet 42, permitting the second fluid to pass into section III and flow toward the inlet end 14 (FIG. 1). From section III, the second fluid similarly flows through section IV and V egressing from the modular shell 22 via outlet 20 at the completion of its pass through section V.

One manner for terminating the end of the arm is appropriate shown in FIG. 2B, wherein a generally "C" shaped notch 210 cooperates with the tube sheet to form a conduit between adjacent segment, while the remaining radial lengths of the arms seal against the tube sheet.

FIG. 3 displays a "dot" and "cross" symbol in a representative multi-walled tube 75 of each nest group to indicate the flow direction of first fluid in the respective segment. A "dot" indicates flow out of the plane of the page, while a "cross" indicates a flow into the plane. Similarly, the flow direction of the second fluid is shown by a like symbol in each segment exterior to the tube set 75 therein.

As evident from FIG. 3, the first and second fluids flow in opposite directions in each of the sections I–V. As is also evident from FIG. 3, the first fluid will be at one temperature extreme (e.g., coldest) in section V, and progressively hotter (to follow the example) in each successive section IV–I as it flows through successive segments in a clockwise direction. The second fluid, on the other hand, is at its temperature extreme (e.g., hottest) in section I, wherein the first fluid is hottest and flows through successive segments in a counter-clockwise direction, and exits from section V, at its coldest, where the first liquid is also at its coldest. Thus, the two fluids continue to exchange heat undirectionally throughout their counterflow in the heat exchanger.

To minimize the risk of temperature-induced stress in the shell resulting from temperature differences between each of the sections I–V, a thin circulating layer of second fluid is provided in the annular, axially extending space 145 between the circumferential arms of the baffle assembly and the inner circumferential wall of modular shell 22. The space 145 is, as previously mentioned, provided by legs **76*a*, 78*a*, 80*a*, 82*a* which support the baffle assembly radially inward from the pressure vessel's 22 wall. As also previously mentioned, the outlet 20 for the second fluid does not include a sleeve such as sleeve 71 of inlet 18**, thereby permitting egressing second fluid to "leak" into, and fill, the space. Accordingly, the temperature of the shell is maintained generally uniform about its circumference.

The second fluid (assumed to be refrigerant for illustrative purposes) in segment I is warmest, is successively colder in segments II–V. Accordingly, the second fluid in space 145 radially adjacent to section I will be warmer, and less dense, than the second fluid in space 145 radially adjacent to section V. Accordingly, the second fluid in space 145 will tend to rise counter-clockwise in FIG. 3. Once the second fluid reaches the 12 o'clock position, gravity causes it to flow downward, completing the loop. Once the space is filled, no additional fluid enters the space, and fluid in the space will slowly circulate counter-clockwise to minimize temperature-induced stresses in the shell.

The end assemblies of the heat exchanger 10 are completed by positioning the end caps 24, 26 onto the neck flange 44, 46 respectively. Bolts 48 are inserted through the apertures 33 in both neck flanges with their heads pointed opposite the heat exchanger. Nuts 50 are then tightened onto the bolts to secure the end assemblies 14, 16.

The holes 149 in the pressure flanges 32, 34 are threaded to engage the bolts 48. Accordingly, the removal of nuts 50 permits disassembly of the end caps 24, 26 for visual inspection of the end baffles without breaking the seal between the (pressure)) flanges 32, 34 and respective neck flanges 44, 46. The tubes 75 may accordingly be inspected through apertures 95 without the voiding of the second fluid in the modular shell 22. This is particularly advantageous when the second fluid is a refrigerant.

Should the need arise to replace any of the tubes 75, the end assemblies can be easily disassembled. The expanded tube/bushing combination requiring replacement can simply be axially slid out of the heat exchanger with the seals of the bushing 41 permitting the axial sliding movement. A replacement bushing/expanded tube combination can then be axially slid through the inner tube sheet 42, modular shell 22, inner tube sheet 40 and the bushing 41 with seals refitted to the replaced tube combination.

Turning to end assembly 16 (FIG. 8), it will be appreciated that any leakage of second heat transfer fluid through gaskets associated with the inner tube sheet 42 or the pressure flange 34 will be drawn into vent chamber 151 and vented to atmosphere by the same method as end assembly 14.

Another feature of the described embodiment is directed to the temperature-induced dimensional changes in the tube sets 75. In the heat exchanger described herein, higher outlet temperatures of the first fluid have been provided using a five segment modular shell with successive counterflowing first and second fluids to increase surface contact time. Because the subchambers or segments I–V represent different temperature zones within the heat exchanger, the tube sets 75 of each segment will expand to a greater or lesser degree than the tubes of the remaining segments.

Accordingly, the aforedescribed configuration permits each tube set 75 to freely expand to the extent required, thereby meeting design codes governing such heat exchangers.

As appreciated from FIG. 8, the tube ends in end assembly 16 are relatively fixed owning to the securing of bushings 104 into which the tubes have been expanded. Referring to FIG. 4, however, it will be appreciated that the other end of the tube set 75 are permitted to "float" axially so that temperature-induced changes in standardized tube length may be accommodated during operation of the heat exchanger. Specifically, outer tube 96 of multi-walled tube 75 may slide axially within the O-ring or tapered seal without loss of sealing contact therebetween. Similarly, inner tube 57 may slide axially within the O-ring or tapered seal without loss of sealing contact between the two. Because tube 57 and tube 96 are joined together by metal contact area 122, multi-walled set tube 75 is one tube of a tube within a tube design and tubes 57 and 96 move simultaneously.

Because the sealed region between the two O-rings or tapered seals remains intact, venting is maintained while the multi-walled tubes are permitted to expand individually with respect to other multi-walled tubes. The heat exchanger thereby herein meets all known potable water codes or regulations as well as the design specification of the ASME pressure vessel codes in the United States, and corresponding foreign codes.

Figure 9:
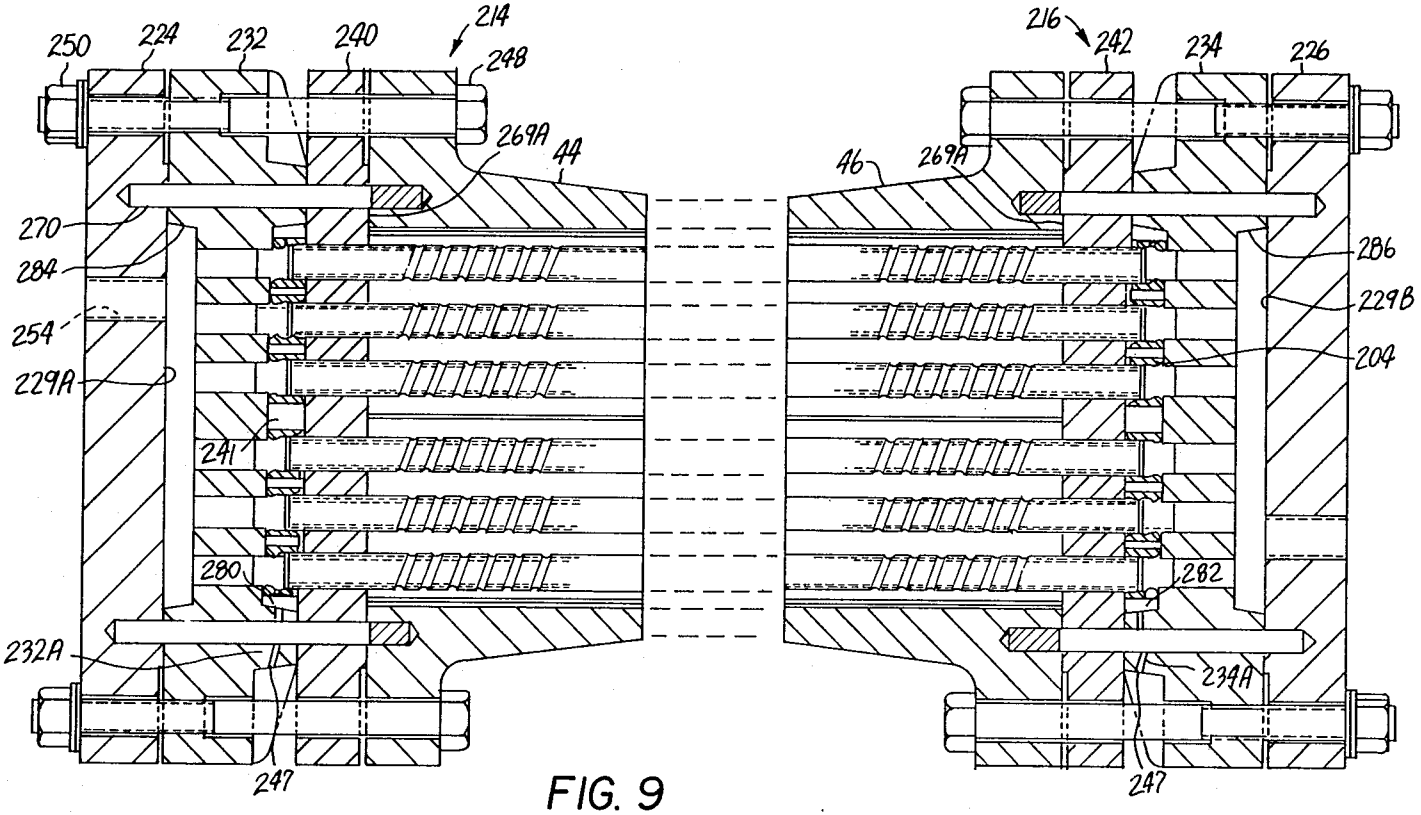
FIG. 9 is a sectional elevation view of an alternative embodiment of a shell and tube type heat exchange in accordance with the invention.
Figure 10:
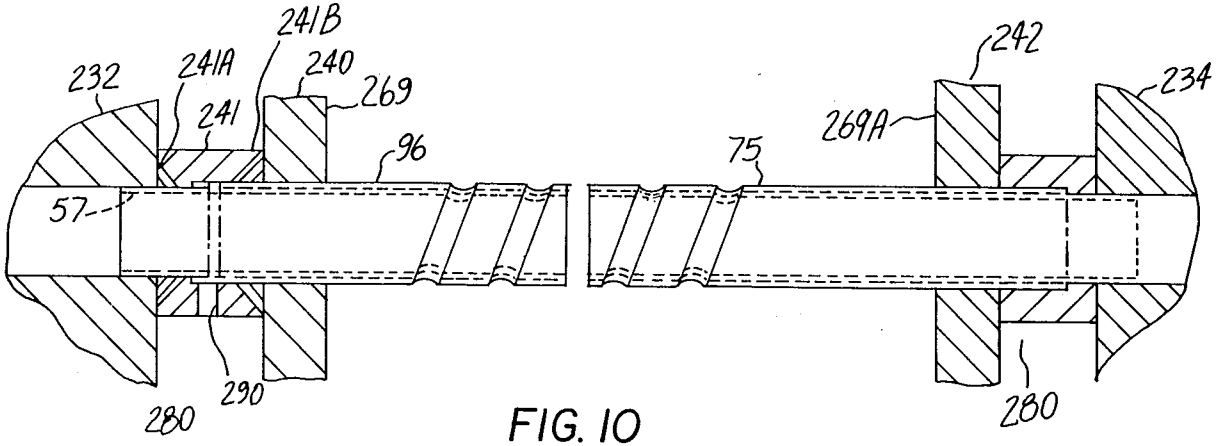
FIG. 10 is an enlarged fragmentary sectional view illustrating a coupling of a multi-walled tube set into opposite end assemblies.
Figure 11:
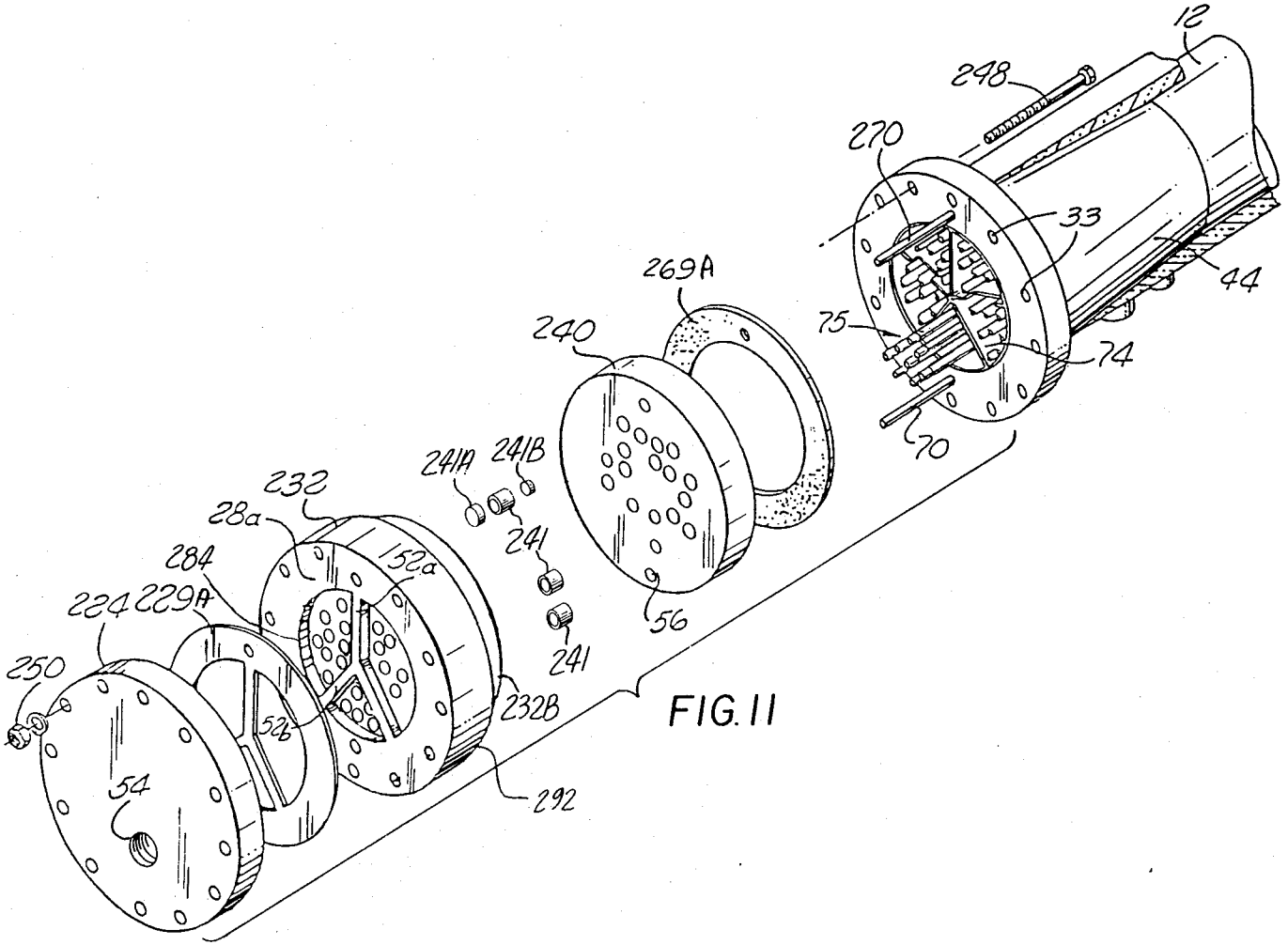
FIG. 11 is an exploded view of the floating end assembly of a heat exchanger in accordance with the invention.

FIGS. 9, 10 and 11 illustrate a later, preferred embodiment of the heat exchange 10 with floating and fixed end assemblies 214, 216 which are somewhat simpler and easier to manufacture than the end assemblies 14, 16. Tube plates 240, 242 are generally cylindrical flat plates with enlarged diameters enabling them to receive locating pins 270 and bolts 248. Annular flange gaskets 269A, 269B seal the periphery of tube plates 240, 242 against the neck flanges 44, 46.

Center plates 232, 234 have a central disk shaped region with an annular flange 232A, 234A extending axially inward to engage the axially outward side of tube plates 240, 242 and form chambers 280, 282 in the interior thereof. The transitioning ends of the tube sets 75 are sealed within the chambers 280, 282 and form a vent chamber for leakage fluid through vent holes 247.

The axially outward sides of center plates 232, 234 have axially annular flanges 284, 286 extending axially outward to be sealed against end plates 224, 226 by cap gaskets 229A, 229B respectively. Ridges or vanes 52A are formed within the annuli 284, 286 to define manifolding chambers for directing the first heat exchange fluid from one group of tube sets 75 to a next sequential group of tube sets 75.

At the floating end a bushing 241 has a small tapered or champered axial bore at the axially outward end for receiving a seal 241B which sealingly, but slidably engages the inner tubes 57. A larger, axially extending bore extends partway through bushing 241 from the axially inward end to slidingly receive seal 241A which seals the outer tube 96. When center plate 232 is bolted to tube sheet 240 seals 241A and 241B are compressed between the opposed faces forming a second seal against the opposed faces to seal the first and second fluids while maintaining a vent passage. A radially extending aperture 290 provides communicates of leakage fluid from leakage path 110 to the venting chamber 280 while a similar bore 247 provides communication through the annulus 232A.

At the fixed end, bushings 204 fixedly seal the tube sets 75 to tube plate 242 and center plate 234 in a manner substantially identical to the sealing provided by bushings 104.

Figure 13:
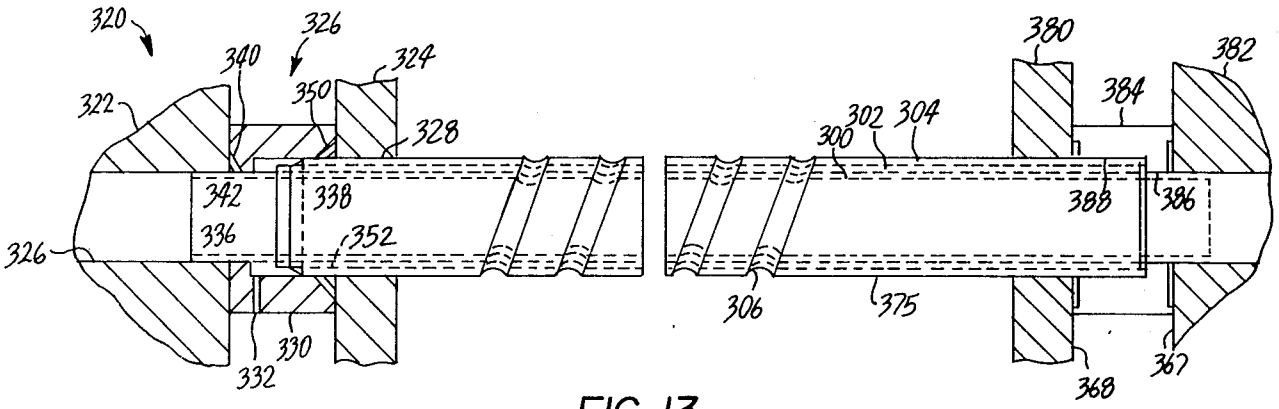
FIG. 13 is an enlarged fragmentary sectional view illustrating a coupling of a triple wall tube set into opposite end assemblies.

Referring now to FIG. 12 and 13, the spiraling and sealing of a triple wall tube set are shown as including a triple wall tube set 375 having a stainless steel inner tube 300, a copper center tube 302, and a stainless steel outer tube 304. The spiral groove deformation 306 is swaged into the set after the three tubes of a set are concentrically assembled and has a width of 0.165 inch as indicated at central region 308, a pitch 310 of 9/16 inch and a depth of 3/16 inch. The deformation leaves spiraling air gap channels 312, 314 having a width of approximately 0.375 inch.

The outer tube 304 has a nominal outside diameter of 3/4 inch and a wall thickness of 0.020 inch. After swaging of the groove 306 outer tube 304 is centerless ground to an actual diameter of 0.749 inch to assure circular ends that will properly seal. The centerless grinding typically reduces wall thickness by approximately 0.001 inch and slightly improves the heat transfer characteristics of the relatively poor heat conducting 321 type stainless steel outer tube 304 by reducing its thickness.

The center tube 302 is made from 98% pure copper and is ground from 0.716 inch to an outside diameter of 0.710 inch prior to assembly into outer tube 304. Center tube 302 has an inside diameter of approximately 0.628 inch. The air channel between outer tube 304 and center tube 302 is thus approximately 0.002 inch thick. The copper center tube 302 primarily serves as a thermally conducting filler between the standard sized outer tube 304 and standard sized inner tube 300.

Inner tube 300 is made of type 316 passivated stainless steel with a nominal outside diameter of 5/8 inch and is centerless ground to an outside diameter of 0.624 inch with a wall thickness of approximately 0.021 inch. This allows the leakage channel 314 to have a thickness of approximately 0.002 inch.

The triple wall tube set 375 thus has a nearly optimum turbulence inducing roughness in the inside of inner tube 300. While the roughness increases frictional pressure loss, it increases heat transfer efficiency. A particularly large heat transfer enhancement can be obtained from a rounded helical ridge having a ridge inside diameter to base tube inside diameter ratio 0.907 and a pitch to inside tube diameter ratio of 0.95. The swaged groove 306 provides inner tube 300 with an internal helical ridge which matches these optimum ratios.

While the outer tube 304 and inner tube 300 are made of stainless steel to provide corrosion resistance against refrigerants and water in the present example, other materials may be used in conjunction with different heat exchange fluids. For some applications, special materials such as titanium may be required to attain adequate corrosion resistance.

The sealing of the ends of the triple tube set 375 is illustrated more specifically in FIG. 13. A floating end assembly 320 includes a center plate 322 and a tube plate 324 defining a vent chamber 326 between them. Inner tube 300 is received by an axial bore 326 in center plate 322 and outer tube 304 is received by a larger axial bore 328 in tube plate 324.

A bushing 330 is placed on the tube set 375 end transition between the center plate 322 and tube plate 324 and has a radially extending vent bore 332 to carry any leakage fluid from the transition to the vent chamber 326.

Bushing 330 has a smaller diameter axial bore 336 adjacent center plate 322 which matingly receives inner tube 300 and a larger diameter axial bore 338 adjacent tube plate 324 and extending axially past bore 332 which matingly receives outer tube 304. A radiused recessed cavity or chamfer 340 is formed at the outer end of small bore 336 which receives a seal 342 which seals the inner tube 300 to the inner surface of center plate 322. Similarly, the large bore 338 has a radiused recessed cavity or chamfer 350 which receives a seal 352 which seals outer tube 304 against the outer surface of tube plate 324.

This floating end sealing arrangement eliminates double O-ring seals which can be severed during assembly. It is impossible to detect this occurrence until a heat exchanger is fully assembled and tested for leakage. When leakage occurs the leaking seal must be identified and the replaced at substantial expense.

A cross sectional view of seal 342 prior to compression is shown in FIG. 14. The seal 342 has a 90° angle between a cylindrical inner diameter face 362 which matingly receives inner tube 300 and an annular or disk shaped flat surface 364 which engages center plate 322. The seal 342 is preferably made of a commercially available VITON material.

Each of the faces 360, 362, 364, 366 have a minimum length of 0.050 inch while the thickness 365 is a minimum of 0.071 inch and the length 367 is approximately 0.212 inch. A minimum width to length ratio of approximately 0.30 and preferably of 0.33 must be maintained to prevent seal 342 from backlong along faces 369 and 371 under the sealing forces. The chamfer of bushing 330 has a radius 331 defining a chamber 331A which, along with a chamber 331B, provides room for thermal expansion of seal 342. The inner diameter of seal 342 is 0.564 inch to require a stretch fit of cylindrical face over the 0.624 inch inner tube 300 to assure a sealing force against the periphery of tube 300. The inside diameter should be stretched between 17 and 22 percent to maintain proper sealing force. The compressive force of bushing 330 forces face 364 into sealing contact with center plate 322. The face 364 should be compressed between 17 and 22 percent relative to an axial width 369 to maintain a proper sealing force. A component of this sealing force is transmitted through seal 342 to create additional sealing force at tube sealing face 362. The construction of seal 350 is similar except that the inside diameter is larger to accommodate the larger outside tube 304.

Seal 352 is similar in shape to seal 342 but is larger in diameter and is preferably made of KALREZ which is a material commercially available from Dupont.

Referring again to FIG. 13, a fixed end assembly includes a tube plate 380 and a center plate 382 having the fixed end transition sealed therebetween by a bushing 384. Bushing 384 has a small axial bore 386 which matingly receives inner tube 300 and a large axial bore 388 which matingly receives outer tube 304. During assembly, bushing 384 is pushed over the fixed end of a tube set 375 and then the tubes are expanded in the vicinity of the bores 386, 388 to secure a fluid tight seal. The tubes are then inserted into gasket 368 and receiving apertures in tube plate 380. Gasket 367 and center plate 382 are then assembled to secure a seal of outer tube 304 against the gasket 368 and outer surface of tube plate 380 and a seal of inner tube 300 against gasket 367 and center plate 382.

Although specific embodiments of the invention have been shown and described above for the purpose of enabling a person skilled in the art to make and use the invention, it will be appreciated that the invention is not limited thereto. Accordingly, any modifications, variations or equivalent arrangements within the scope of the attached claims should be considered tobe within the scope of the invention.

What is claimed is:

1. An elongated shell and tube, high efficiency multipass heat exchanger with substantial freedom from thermal stress causing mechanical distortions comprising:

an exterior housing defining an outer shell with inner and outer surfaces;

a modular, cylindrical, heat conductive, axially extending inner shell having inner and outer surfaces disposed within the exterior housing and comprising a plurality of modular extrusions which are sealingly interlocking and axially slidable relative to adjacent extrusions, the modular shell and the exterior housing defining a thin axially extending annular space therebetween, the modular extrusions defining a plurality of internal chambers within the modular shell providing a second heat exchange fluid flow path having a plurality of serially connected axially extending individual flow paths through the shell for a second heat exchange fluid;

inlet means and outlet means connected at opposite ends of the second heat exchange fluid flow path;

means for circulating a first heat exchange fluid through the heat exchanger tubes in multi-pass counter flow to the second heat exchange fluid;

means on the outside surfaces of the modular shell separating it from the inner surface of the heat exchanger housing to define a thin gap for the circulation of a thin equalizing layer of second heat exchange fluid therein to maintain shell temperature and heat exchanger housing temperature within selected pressure vessel limits; and means for circulating the second heat exchange fluid between the modular shell and heat exchanger housing.

2. A heat exchanger for exchanging heat between first and second heat exchange fluids comprising:

an axially extending cylindrical outer shell having an inlet port at one end thereof and an outlet port at an opposite end thereof:

a baffle assembly disposed within the shell and defining a plurality of serially coupled chambers providing a multi-pass serial flow path through the shell for the second heat exchange fluid, the baffle assembly including a plurality of axially extending baffle members, each baffle member having a radially extending arm and a circumferentially extending arm extending from a radially outward extremity of the radially extending arm, a radially inward extremity of each radially extending arm forming an axially slidable interlocking seal with a radially inward extremity of an adjacent radially extending arm on each side thereof and a radially outward extremity of each radially extending arm forming an axially slidable interlocking seal with a circumferentially extending arm of an adjacent baffle member;

a plurality of tube sets extending axially through the shell, each tube set including at least an inner tube and a concentric outer tube and having a spiral groove;

a floating end assembly receiving and sealingly engaging a floating end of each tube set, the floating end assembly including a tube plate having a plurality of axial apertures which each receive an outer tube of a different tube set, a center plate having a plurality of axial bores which each receive an inner tube of a different tube set, a bushing for each tube set, each bushing having a large axial bore for matingly receiving an outer tube and a small axial bore concentric with and extending to the large axial bore for matingly receiving an inner tube, a recessed cavity surrounding each of the large and small axial bores at respective opposite ends thereof, a plurality of first seals, each first seal being disposed within the recessed cavity of the large axial bore of a bushing and sealing the mating outer tube to the tube plate, a plurality of second seals, each second seal being disposed within the recessed cavity of the small axial bore of a bushing and sealing the mating inner tube to the center plate, and means for guiding the first heat exchange fluid between different floating ends of tube sets to provide a multi-pass flow through the shell; and a fixed end assembly receiving and sealingly engaging a fixed end of each tube set and including means for guiding the first heat exchange fluid between different fixed ends of the tube sets to provide a multi-pass flow through the shell.

3. The heat exchanger according to claim 1 wherein each tube set includes three concentric tubes.

4. The heat exchanger according to claim 2 wherein the spiral groove provides at the inside of the innermost tube a ridge inside diameter to base inside diameter of 0.97.

5. The heat exchanger according to claim 4 wherein the spiral groove provides at the inside of the innermost tube a pitch to base diameter ratio of 0.95.

6. An end assembly for receiving and sealing floating ends of multi-wall tube sets in a heat exchanger, the end assembly comprising:

a tube plate having a plurality of apertures, each matingly receiving a different tube set;

a center plate having a plurality of apertures each matingly receiving an innermost tube of a different tube set, the center plate and tube plate forming walls of a chamber defined therebetween;

a plurality of bushings disposed in the chamber, each bushing being received by an end of a different tube set and having a larger axial bore matingly receiving an outermost tube of a given tube set, a smaller axial bore extending to the larger axial bore receiving an innermost tube of the given tube set, a large diameter recessed cavity concentrically surrounding the larger diameter bore and a small diameter recessed cavity concentrically surrounding the small diameter bore;

a plurality of first seals, each first seal being disposed in the large diameter recessed cavity and sealing an outermost tube of a received tube set to the tube plate; and a plurality of second seals, each second seal being disposed in the small diameter recessed cavity and sealing an innermost tube of a received tube set to the center plate.

7. A seal assembly for sealing an axially extending heat exchanger tube relative to a face of a plate, the face extending perpendicular to the axis, the assembly comprising:

a bushing having an axial bore for matingly receiving the tube and a recessed cavity disposed concentrically about the bore;

a generally annular seal disposed within the recessed cavity and having a cylindrical surface bearing against the tube periphery and an annular flat surface extending parallel to and bearing against the face of the plate, the annular flat surface of the seal being radially spaced apart from the cylindrical surface of the seal and the cylindrical surface of the seal being axially spaced apart from the annular flat surface of the seal so as to form a cavity at a juncture of the face of the plate and the tube; and means for forcing the bushing toward the face of the plate to force the seal into sealing engagement with the face and with the heat exchanger tube.

8. A seal assembly according to claim 7 wherein a cross section of the seal along a plane containing the axis and a center point of the seal has a minimum width to length ratio of 0.30 wherein the length is measured from a point at a radially outward extremity of the annular flat surface to a point on the cylindrical surface farthest from the annular flat surface and width is measured in a direction perpendicular to the length at a position central to the length.

9. A seal assembly according to claim 7 wherein the cross-section of the seal has a minimum width to length ratio of 0.33.

10. A seal assembly for sealing an axially extending heat exchanger tube relative to a face of a plate, the face extending perpendicular to the axis, the assembly comprising:

a bushing having an axial bore for matingly receiving the tube and a recessed cavity disposed concentrically about the bore;

a generally annular seal disposed within the recessed cavity and having a cylindrical surface bearing against the tube periphery and an annular flat surface radially spaced apart from the cylindrical surface and extending parallel to and bearing against the face of the plate, the assembly having seal expansion absorbing chambers defined between the seal and a juncture of the tube and face on one side of the seal and between the seal and a wall of the bushing recessed cavity on an opposite side of the seal.

11. A sealing assembly for sealing an axially extending heat exchanger tube relative to a face of a plate, the face extending perpendicular to the axis, the assembly comprising:

a bushing having an axial bore for matingly receiving the tube and a recessed cavity disposed concentrically about the bore;

a generally annular seal disposed within the recessed cavity and having a cylindrical surface with an inner diameter stretched between 17 and 22 percent about the tube and bearing against the tube periphery and an annular flat surface radially spaced apart from the cylindrical surface and extending parallel to and bearing against the face of the plate, the axial width of the seal being compressed between 17 and 22 percent at the annular flat surface; and means for forcing the bushing toward the face to force the seal into sealing engagement with the face.

12. A seal assembly for sealing an axially extending heat exchanger tube relative to a face of a plate, the face extending perpendicular to the axis, the assembly comprising:

a bushing having an axial bore matingly receiving the tube and a recessed cavity disposed concentrically about the bore, the bushing having an annular flat surfcae disposed in facing relationship to the face of the plate, the recessed cavity including a cylindrical surface adjacent the annular surface of the bushing and defining an inner periphery of the annular surface which is concentric with and somewhat larger in diameter than the bore, the cavity further having a flat annular surface axially spaced from the annular flat surface of the bushing, concentric with the central axis and intersecting the bore at an inner periphery thereof;

a generally annular seal disposed within the recessed cavity of the bushing, the seal having, a first annular surface disposed in facing, sealing engagement with the face of the plate, the first annular surface having a radially inward periphery that is spaced apart from the tube and a radially outward periphery a first cylindrical surface concentric with the axis and engaging the cylindrical surface of the bushing cavity in facing mating relationship, a second annular surface axially spaced from the first annular surface, the second annular surface being in facing, mating engagement with the annular surface of the bushing cavity, and a second cylindrical surface axially spaced from and smaller in diameter than the first cylindrical surface, the second cylindrical surface being in facing, sealing engagement with an outer surface of the tube, the seal defining a cavity at a juncture of the first annular surface and second cylindrical surface of the seal, the seal defined cavity accommodating expansion of the seal at a central portion of a seal cross-section along a plane passing through the axis upon compression of the seal at extremities of the seal cross-section; and means for forcing the bushing toward the face of the plate to force the first annular surface into sealing engagement with the plate and the second cylindrical surface into sealing engagement with the tube.

13. A seal assembly according to claim 12 wherein the seal has a first surface extending between the first annular surface and the second cylindrical surface and a second surface extending between the first cylindrical surface and the second annular surface, the first and second surfaces producing straight lines in the cross-section.

* * * * *

UNITED STATES PATENT AND TRADEMARK OFFICE

CERTIFICATE OF CORRECTION

PATENT NO. : 4,871,014

DATED : October 3, 1989

INVENTOR(S) : Kevin J. Sulzberger

It is certified that error appears in the above-identified patent and that said Letters Patent is hereby corrected as shown below:

Title Page, U.S. PATENT DOCUMENTS, 4,210,199, "Doucett et al." should read --Doucette et al.--

Column 2, line 28, "McK" should read --McKnight discloses a--.

Column 2, lines 40-41, "heat exchanges" should read --heat exchangers--.

Column 11, line 48, "vent chamber 4" should read --vent chamber 45--.

Column 12, line 62, "heat exchange" should read --heat exchanger--.

Column 17, line 40, "backlong" should read --buckling--.

Column 18, line 15, "tobe" should read --to be--.

Column 19, line 39, "claim 1" should read --claim 2--.

Column 20, line 33, before "width" insert --the--.

Column 21, line 17, "surfcae" should read --surface--.

Signed and Sealed this

Fourth Day of September, 1990

*Attest:*

HARRY F. MANBECK, JR.

*Attesting Officer*

*Commissioner of Patents and Trademarks*